US005609327A

United States Patent [19]

Amidon

[11] Patent Number: 5,609,327

[45] Date of Patent: Mar. 11, 1997

[54] PORTABLE FENCE PANEL

[76] Inventor: William D. Amidon, P.O. Box 1418, 5402 Main Ave., Ashtabula, Ohio 44005-1418

[21] Appl. No.: 415,728

[22] Filed: Apr. 3, 1995

[51] Int. Cl.[6] ..... E04H 17/16

[52] U.S. Cl. ..... 256/24; 256/19; 256/25; 256/26; 256/65; 446/112; 446/122

[58] Field of Search ..... 256/19, 24, 25, 256/26, 27, 65, 73; 52/169.1, 285.1, 285.4, 582.1, 587.1; 160/135, 229.1; 446/111, 112, 122, 123

[56] References Cited

U.S. PATENT DOCUMENTS

| | | | |
|---|---|---|---|
| 2,057,942 | 10/1936 | Fay | 446/112 |
| 2,175,698 | 10/1939 | Netz | 40/605 |
| 3,204,606 | 9/1965 | Parr et al. | 256/26 X |
| 3,402,787 | 9/1968 | See | 182/118 |
| 4,844,424 | 7/1989 | Krudslien | 256/26 |
| 5,137,485 | 8/1992 | Penner | 446/111 |
| 5,161,783 | 11/1992 | German | 256/19 |
| 5,161,784 | 11/1992 | Sader | 256/24 |
| 5,180,143 | 1/1993 | Brower | 256/24 |
| 5,219,241 | 6/1993 | Picton | 404/6 |
| 5,303,900 | 4/1994 | Zulick, III | 256/65 |

FOREIGN PATENT DOCUMENTS

| | | | |
|---|---|---|---|
| 2309694 | 7/1976 | France . | |
| 2589675 | 5/1987 | France . | |
| 5311926 | 11/1993 | Japan . | |
| 2068036 | 8/1981 | United Kingdom | 256/24 |

OTHER PUBLICATIONS

Exhibit A—Photograph disclosing Animal Pen arrangements. Aug. 1994.

Exhibit B—photograph disclosing Animal Pen arrangements. Aug. 1994.

Exhibit C—photograph disclosing 16 Foot gate. Apr. 1994.

Exhibit D—photograph disclosing connector for gate arrangement.

*Primary Examiner*—Brian K. Green
*Assistant Examiner*—Andrea Chop
*Attorney, Agent, or Firm*—Robert R. Hussey Co., LPA

[57] ABSTRACT

A portable fence panel for use on a support surface includes a rectangular frame member having a pair of side frame portions and a top and bottom frame portion. The frame portions have an outer and inner surface defining an aperture through the frame member. The panel includes crossmembers in the frame aperture for restricting passage therethrough. One of the side frame portions has at least one first connector portion extending therefrom defining a connector surface and having at least one aperture therethrough. The panel also includes at least one second connector portion extending from the other side frame portion having a connector surface which is substantially coplanar with the connector surface of the first connector portion. The second connector portions extend in a direction opposite the first connector portion and have at least one aperture therethrough. The panel also includes supports extending from the bottom frame portion. The supports have a contact portion supported by the support surface and a connector portion having at least one aperture therethrough. To connect a plurality of fence panels, a pin is positioned through one of the connecting portion apertures in a connector portion of a first and second panel and a second pin is positioned in a second connector portion aperture of the first panel and a connector portion aperture in a third panel.

12 Claims, 6 Drawing Sheets

PORTABLE FENCE PANEL

BACKGROUND OF THE INVENTION

The present invention relates generally to fence panels and in particular to portable plastic fence panels.

Portable fence panels are used extensively to contain animals during fairs, circuses, animal exhibitions and auctions. For example, a main attraction at county fairs and carnivals are the animal display areas. These display areas are typically used to exhibit and show various animals and livestock. To separate different sizes and breeds of animals, temporary animal pens are assembled using portable fence panels. Accordingly, different pen dimensions are needed to accommodate different sized animals.

Portable fence panels are manufactured in various heights and widths to form different sized pens for different animals. For example, panels with increased height form pens to contain large animals. With such a variety of animals to be displayed, a number of different sized panels must be transported and reassembled when an animal exhibition changes location. During transport, the handling of different sized panels is cumbersome and reassembling the panels time consuming. Accordingly, it is desirable to provide a portable fence panel having a predetermined dimension that can be positioned horizontally to accommodate small animals and vertically to accommodate large animals.

During their stay at a location, animals may be moved to different temporary pens. If a large animal is involved, the move may require the disassembly of a pen with short dimensions and assembly of a taller pen. Accordingly, it is desirable to provide a portable fence panel which can be stacked upon another portable fence panel to accommodate large animals.

The temporary pens are generally arranged beside one another to maximize space while permitting spectators to quickly and conveniently view the animals. Fence panels are used to construct rows of animal pens. When constructing a row of pens, two lines of fence panels have cross panels extending between the lines of panels forming a row of pens. Accordingly, it is desirable to provide a connection between two lines of panels and the cross panels to form the row of pens.

When two adjacent rows of pens are constructed, it is desirable to provide a connection between adjoining panels of the middle line of panels and each of the cross panels forming the two adjacent rows of pens. Likewise, it is desirable to provide a portable fence panel having connectors which allow four portable fence panels to be joined at one connection.

The temporary animal pens used at various animal displaying events are typically made of metal or wood. Since these events frequently change location, disassembly of the temporary pens is frequently required. During disassembly, transport and reassembly, the metal or wooden fence panels are subject to repeated wear and tear.

Portable metallic fence panels are easily scratched and damaged during set up, break down and transfer. This continuous damage to the fence panels detract from their appearance. Moreover, damaged metallic panels are susceptible to rust and oxidation. Damaged metallic fence panels have sharpened or rough edges which can potentially harm an animal as well as cause tetanus. Furthermore to control oxidation, metallic panels may be painted to cover the scratches. Repeated painting of metallic fence panels creates a distractive appearance and becomes time consuming and expensive. Accordingly, it is desirable to provide a portable fence panel made of a structurally semi-rigid material. It is also desirable to provide a portable fence panel which does not require painting. Furthermore, it is desirable to provide a portable fence panel having rounded edges to prevent animal injury.

Metal fence panels can also be bent during moving or by the impact of an animal against the panel. A bent metal fence panel remains misshaped making later alignment with additional panels difficult. Furthermore, the damaged metallic panel weakens at the bent portions. This weakening could later result in early failure of the panel.

Accordingly, it is desirable to provide a portable fence panel that has structural rigidity. It is also desirable to provide a portable fence panel that can yield to impact forces and yet retain its original dimensions.

Portable fence panels typically remain set up for the duration of the animal displaying event. If left in the same position for an extended period, panel arrangements need realigning due to the animals or spectators repeated contact with the panels. If positioned outdoors, realignment may also be required due to inclement weather. In addition, it may be desirable to maintain a panel arrangement on one's property for a continued period of time. Accordingly, it is desirable to provide a portable fence panel allowing for continued use with minimal realignment.

Likewise, panel arrangements are generally used indoors, and if used outdoors, do not take into account damaging ultra-violet radiation. Accordingly, it is desirable to provide a portable fence panel that resists ultraviolet rays.

Portable wooden fence panels are heavy and typically require the assembly of many components and are difficult to transport. In addition, wooden fence panels absorb water, bacteria and surrounding odors. Accordingly, it is desirable to provide a portable fence panel which is lightweight and easily assembled. It is also desirable to provide a portable fence panel which is non-absorbent and can be pressure washed.

SUMMARY OF THE PRESENT INVENTION

The present invention provides the above described desirable features with an improved portable fence panel. The portable fence panel of the present invention is provided for use on a support surface to improve the containment of animals and includes a substantially rectangular plastic frame member having a pair of side frame portions and a top and a bottom frame portion. Each of the frame portions have an outer surface and an inner surface which define an aperture through the frame member. The portable fence panel includes means positioned in the aperture of the frame member for restricting passage therethrough.

The fence panel may be connected to other fence panels to form a line of panels or a row of pens. The panels are connected by joining connector portions of one panel with complementary connector portions of a second panel.

To connect the fence panels, first connector portions are formed to a side frame portion. Each of the first connector portions has a connector surface from which the first connector portion extends along the side frame portion. The first connector portions have a pair of apertures therethrough.

Second connector portions are formed to the other side frame portion of the portable fence panel. Each of the second connector portions have a connector surface in a plane substantially coplanar with the connector surface of a complimentary first connector portion. The second connector portions extend from the connector surface along the other side frame portion in a direction opposite from which its complimentary first connector portion extends. The second connector portions have a pair of apertures therethrough.

To connect fence panels, the connector surfaces of a first connector on one panel and a complementary second connector on another panel are positioned facing each other. The apertures of the first connector are aligned with the apertures of the complementary second connector. A pin is positioned through the aligned apertures to connect the fence panels.

The portable fence panel also includes a pair of support portions formed to the bottom frame portion. Each of the supports has a contact portion spaced from the bottom frame portion for supporting the fence panel. Each of the supports also has a connector portion having a connector surface defining one side of the support. The connector portion of the support portion has a pair of apertures therethrough.

A portable fence panel connection is provided for connecting a number of fence panels at one junction. To connect two panels, a pin is positioned in one of the apertures in a connector portion of a first panel and one of the apertures of a connector portion of a second panel. To connect three panels at a junction, a second pin is positioned in a second aperture of the connector portion of the first panel and one of the apertures in a connector portion of a third panel to connect the first, second and third panels. If it is desirable to connect four panels at a junction, a third pin is positioned in a second aperture of the connector of the second panel and one of the apertures in a connector of a fourth panel.

The portable fence panel of the present invention can be positioned horizontally to accommodate small animals and vertically to accommodate large animals. The support portions of the bottom frame portion support the portable fence panel in the horizontal position. Likewise, when the fence panel is rotated 90° and used in the vertical position, the side frame connector portions function as the bottom frame support portions and the connector portions on the top and bottom portions operate to connect adjacent panels.

The present invention also provides a portable fence panel that can be mounted on a portable fence panel for a fence of increased height to accommodate large animals.

The portable fence panel of the present invention provides for the connection of a row of animal pens. The portable fence panel of the present invention also provides for connectors which allow for the connection of a cross panel between two lines of fence panels. The present invention further provides a portable fence panel having connectors which permit up to four portable fence panels to be joined at one juncture.

The portable fence panel of the present invention may be subject to inclement weather or excessive contact and subsequently misalignment. The support portions of the bottom frame portion allow for engaging both indoor and outdoor surfaces. The support portions also allow for continued use of the fence panel in the same arrangement. When the portable fence panel needs to be transported, the panel is readily removable from engagement with the support surface.

The portable fence panel may be used indoors or outdoors. The present invention provides a portable fence panel of plastic material containing an ultraviolet retardant to minimize damage from ultraviolet radiation when used outdoors. The plastic material forming the fence panel of the present invention has pigment coloring that does not require painting, even when scratched. Different fanciful configurations, such as wood graining, can be molded into the frame member to simulate an appropriate material such as wood.

The present invention provides a portable fence panel made of a structurally semi-rigid material so as to decrease the possibility of animal injury as a result of contact with the panel. The portable fence panel of the present invention also provides the desirable feature of yielding to applied pressure while retaining its original dimensions.

Other desirable features and advantages of the present invention will become apparent from a study of the following description and the accompanying drawings which are illustrative of the invention.

BRIEF DESCRIPTION OF THE INVENTION

DETAILED DESCRIPTION OF THE INVENTION

Figure 1:
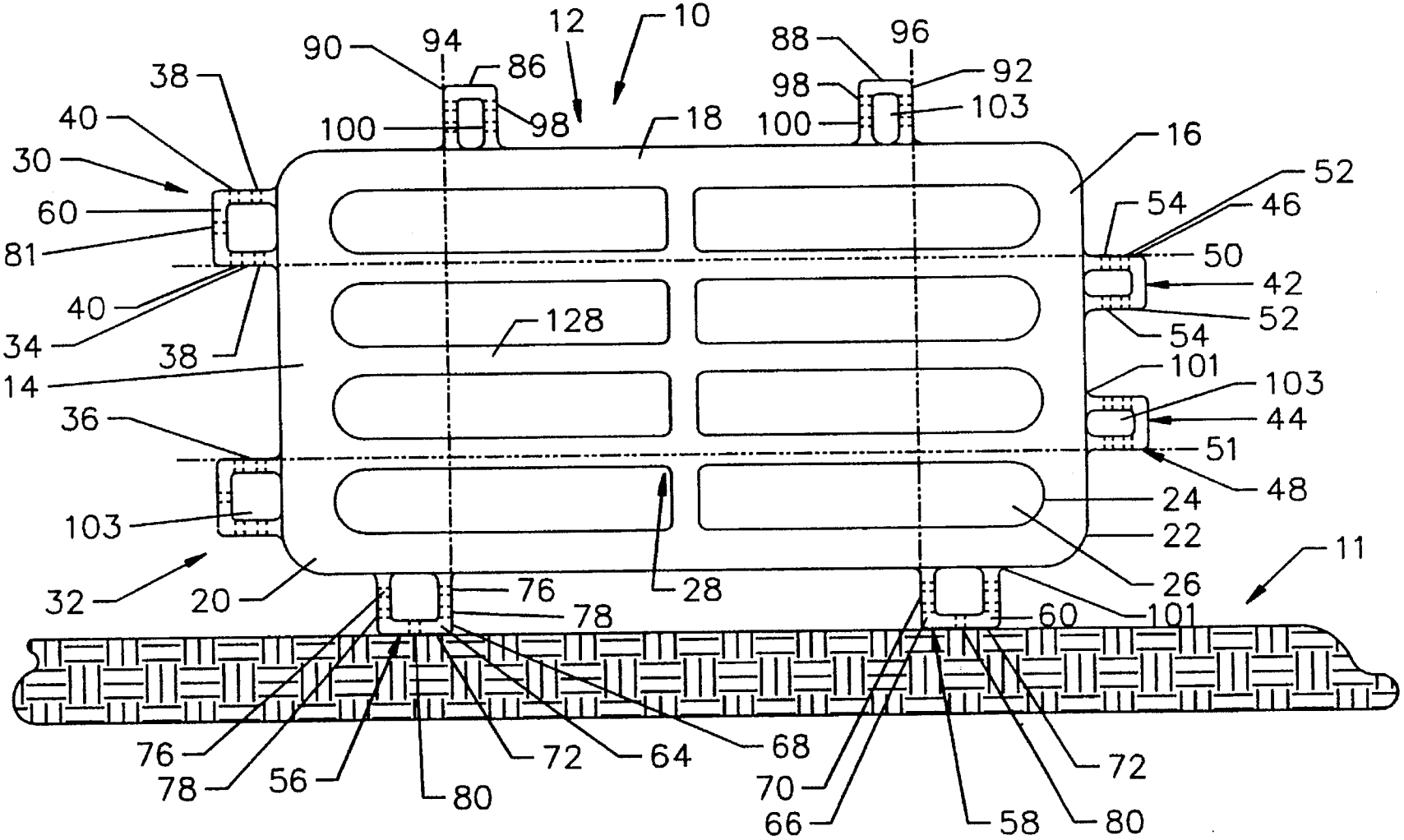
FIG. 1 is a side view of the portable fence panel of the present invention.

A portable fence panel 10 is provided as shown in FIG. 1 for use on a support surface generally indicated at 11 to facilitate the containment of different sized animals.

The portable fence panel 10 of the present invention includes a substantially rectangular plastic frame member 12. The frame member 12 has a pair of side frame portions 14, 16, a top frame portion 18 and a bottom frame portion 20. Each of the frame portions have an outer surface 22 and an inner surface 24 which define an aperture 26 through the frame member 12. The portable fence panel 10 includes means, generally indicated at 28, positioned in the aperture 26 of the frame member 12 for restricting passage therethrough.

Figure 2:
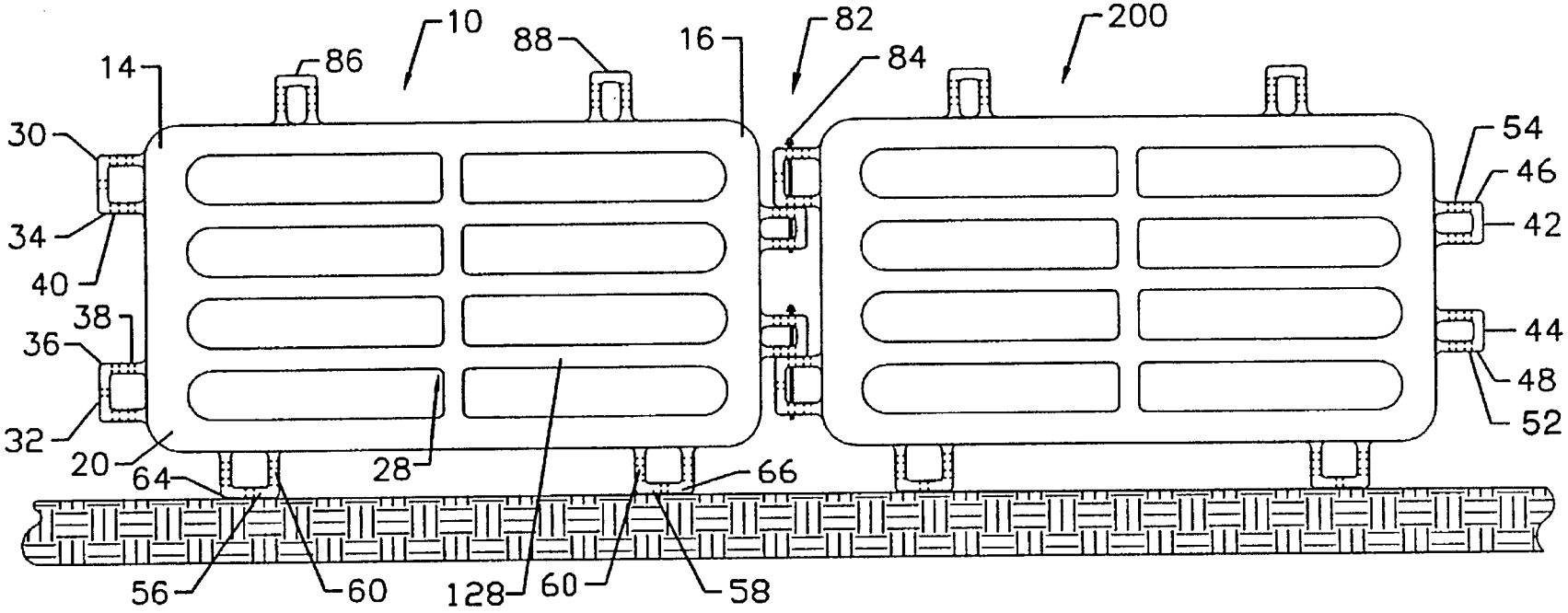
FIG. 2 is a side view of the embodiment of two connected portable fence panels.

As seen in FIG. 2, the fence panel 10 can be connected to another fence panel 200 to form a line of panels or a row of pens. The panels 10, 200 are connected by joining connector portions 30, 32 of one panel 200 with complementary connector portions 42, 44 of another panel 10.

To connect the fence panels 10, 200, first connector portions 30, 32 are formed on a side frame portion 14, as seen in FIGS. 1 and 2. The side frame portion 14 has an upper first connector portion 30 and a lower first connector portion 32 extending therefrom along the side frame portion 14. The upper first connector 30 defines a connector surface 34 with the upper first connector 30 extending from the connector surface 34 in an upward direction a predetermined length or distance along the side frame portion 14. The lower first connector 32 defines a connector surface 36 with the lower first connector 32 extending from the connector surface 36 in a downward direction a predetermined length or distance along the side frame portion 14. Each of the first connector portions 30, 32 has two pairs of apertures 38, 40 therethrough along respective axes that are substantially parallel to the side frame portion 14. Apertures 38, 40 are positioned predetermined distances from the outer surface 22 of side frame portions 14.

The portable fence panel 10 also includes upper and lower second connector portions 42, 44 extending from the other of the side frame portions 16. The upper second connector portion 42 defines a connector surface 46 in a plane 50 substantially coplanar with the connector surface 34 of a complimentary upper first connector 30. The lower second connector 44 defines a connector surface 48 in a plane 51 substantially coplanar with the connector surface 36 of a complimentary lower first connector 32. For example, when connecting fence panels 10, 200, the connector surfaces 34, 36 of first connectors 30, 32 of panel 200 are positioned mirroring the connector surfaces 46, 48 respectively, of second connectors 42, 44 of panel 10. The upper second connector 42 extends from the connector surface 46 in a downward direction along the side portion 16 a length or distance less than the predetermined length that the upper first connector portion 30 extends along the side frame portion 14. The lower second connector 44 extends from the connector surface 48 in an upward direction along the side portion 16 a length or distance less than the predetermined length that the lower first connector portion 32 extends along the side frame portion 14.

Each of the second connector portions 42, 44 has two pairs of apertures 52, 54 therethrough along respective axes that are substantially parallel to the side frame portion 16. Apertures 52, 54 are positioned predetermined distances from the outer surface 22 of the side frame portion 16. The predetermined distance by which the pair of apertures 52, 54 are positioned is substantially equal to the predetermined distances by which the pair of apertures 38, 40 are positioned from the side frame portion 14.

As seen in FIG. 1, the plane 50 lies towards the top of and across the panel 10 through the connector surfaces 34, 46 of connector portions 30, 42 respectively. The plane 51 lies across the panel 10 through the connector surfaces 36, 48 and towards the bottom of the panel 10. The planes 50, 51 are positioned across the panel 10 so that additional panels having corresponding planes 50, 51 may be connected along the same planes, as seen from FIGS. 1 and 6.

Figure 3:
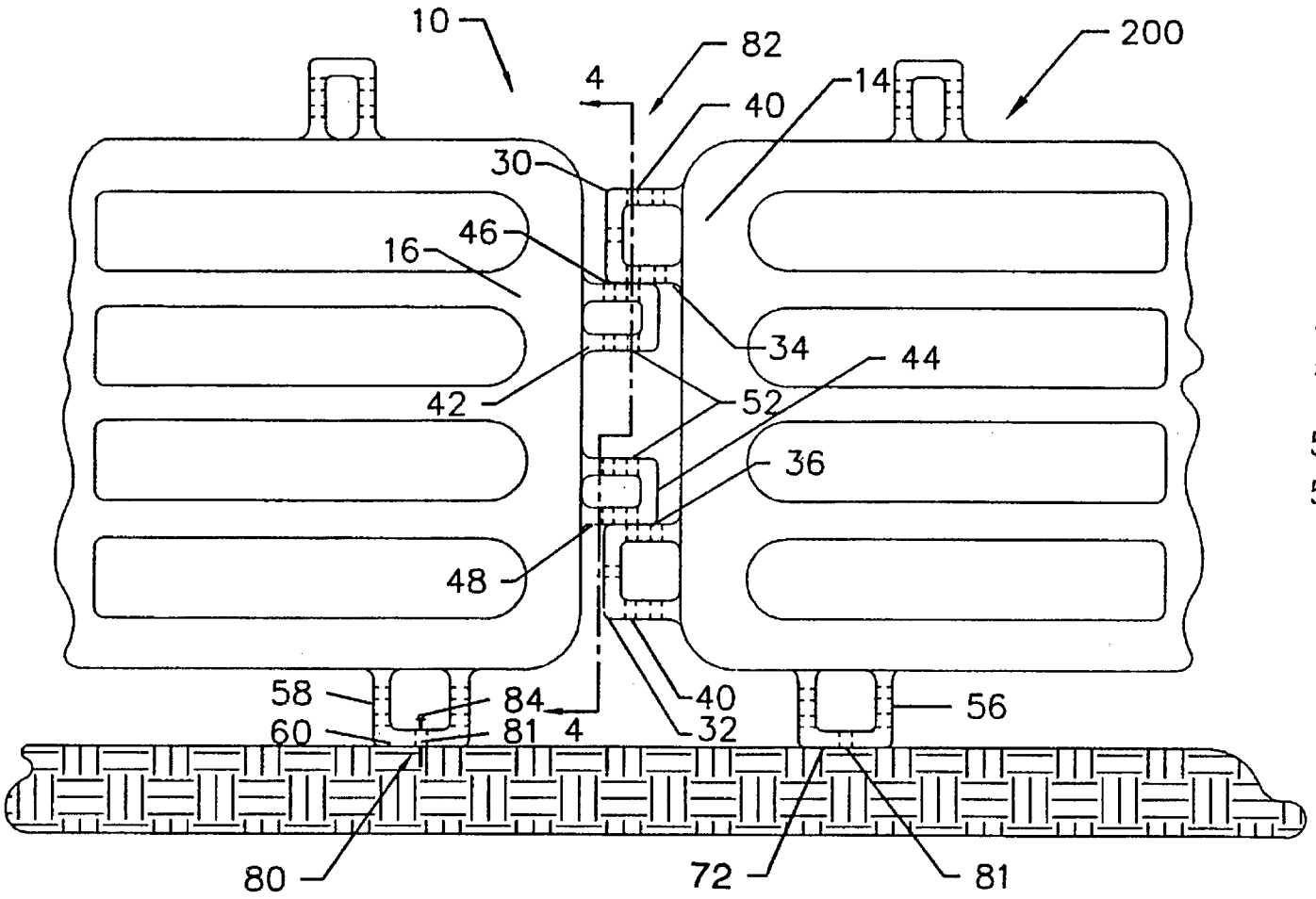
FIG. 3 is an enlarged side view of a portion of the embodiment of two connected portable fence panels.

FIG. 3 is an enlarged view of a portion of the panels 10, 200 illustrating how they are connected together. The side frame portion 14 of panel 200 is shown disposed adjacent the side frame portion 16 of panel 10. The panels 10, 200 are connected by joining connector portions 30, 32 of panel 200 with complementary connector portions 42, 44 of panel 10. The connector surfaces 34, 36 of first connectors 30, 32 respectively, are positioned facing the connector surfaces 46, 48 of complementary second connectors 42, 44. The panels 10, 200 are joined by aligning apertures 52 of second connectors 42, 44 with apertures 40 of first connectors 30, 32 to provide a connection between two panels 10, 200. A pin 84, shown in FIG. 2, is positioned through the aligned apertures 40, 52 to secure the connection between the two panels 10, 200.

Figure 4:
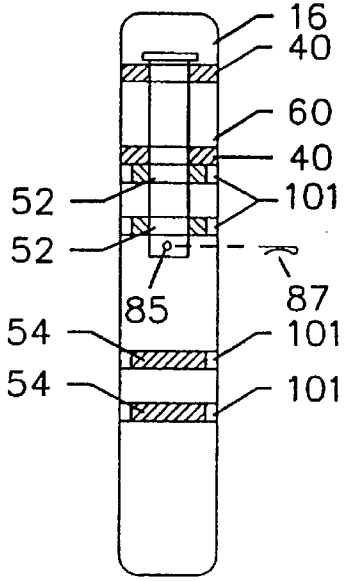
FIG. 4 is an enlarged partial sectional view of the embodiment shown in FIG. 3 and taken along lines 4—4 thereof.

As seen in FIG. 4, the pin 84 has an aperture 85 at one end to receive a hitch pin 87. The hitch pin 87 is positioned through the aperture 85 to retain the pin 84 in the aligned apertures 40, 52. It should be understood that when pin 84 secures the connection between any panels the pin 84 is retained by hitch pin 87.

As seen in FIG. 3, the pair of apertures 52 of the second connectors 42, 44 of first panel 10 are in substantial linear alignment with the pair of apertures 40 of first connectors 30, 32 of the adjoining second panel 200. It should be understood that the two pairs of apertures 52, 54 of the second connectors 42, 44 of the first panel 10 may be positioned in substantial linear alignment with the two pairs of apertures 38, 40 respectively, of the first connectors 30, 32 of an adjoining panel 200. It should be understood that it is within the contemplation of this invention that the connection of panels 10, 200 may be achieved by aligning both pairs of apertures 52, 54 of the first panel 10 with the two pairs of apertures 38, 40 respectively of the second panel 200 and positioning pins 84 therethrough.

As seen in FIG. 1, the second connector portions 42, 44 are similar to the first connector portions 30, 32. The main difference being that first connectors 30, 32 are larger and include a contact portion 60 spaced from the side portions 14. The contact portions 60 have an aperture 81 therethrough as will be herein further described. First connectors 30, 32 have larger dimensions in order to operate as support portions for the fence panel 10 as will be herein further described.

The portable fence panel 10 may be positioned on various support surfaces without damage to the bottom frame portion 20. To provide support from the support surface 11, the fence panel 10 includes two support portions 56, 58 extending from the bottom frame portion 20. Each of the support portions 56, 58 has a contact portion 60 spaced from the bottom frame portion 20. Each contact portion 60 has a contact surface 72 defining a bottom side of the support portions 56, 58. When the fence panel 10 is positioned horizontally, the contact surfaces 72 are supported by the support surface 11 as will herein be further described.

The support portions 56, 58 also operate as connector portions. Each of the support portions 56, 58 has a connector portion 64, 66 respectively. Each connector portion 64, 66 has a connector surface 68, 70 respectively, defining one side of the support portions 56, 58. When connecting two panels 10, 200 vertically, the support portions 56, 58 operate as connector portions as will herein be further described.

The support portions 56, 58 are substantially identical to the first connector portions 30, 32. The connector portions 64, 66 of the support portions 56, 58 have two pairs of apertures 76, 78 therethrough along respective axes that are substantially parallel to the bottom frame portion 20. The apertures 76, 78 are positioned a predetermined distance from the outer surface 22 of the bottom frame portion 20. Each contact portion 60 of first connectors 30, 32 and support portions 56, 58 has means 80 for removably engaging the support surface 11 as will be herein further described.

Figure 5:
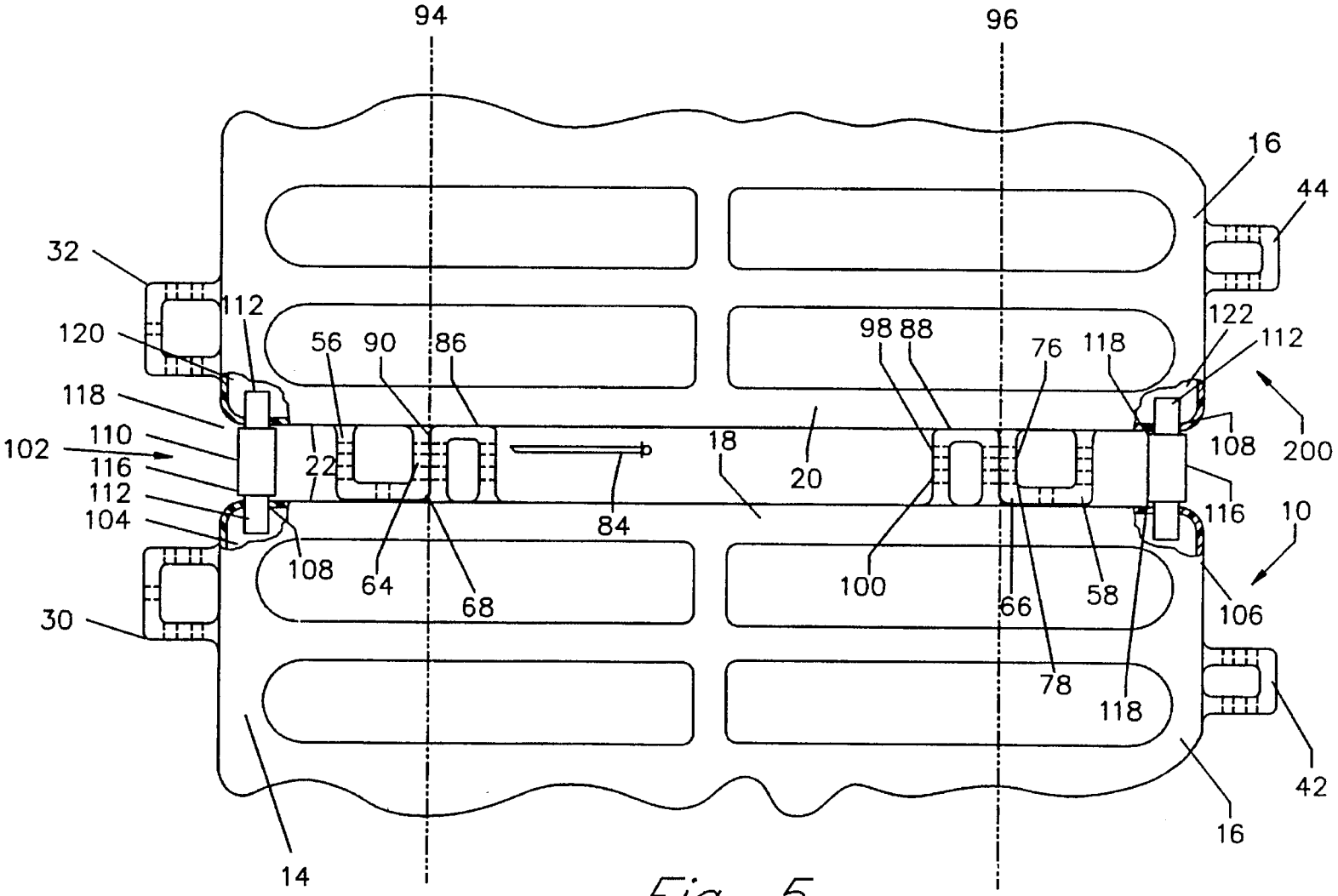
FIG. 5 is an enlarged partial side view of an alternate embodiment of two connected portable fence panels of the present invention.

As seen in FIGS. 1 and 5, the portable fence panel 10 also includes two top connector portions 86, 88 extending from the top frame portion 18. The top connector 86 defines a connector surface 90 in a plane 94 substantially coplanar with the connector surface 68 of a complimentary support portion 56. The other top connector 88 defines a connector surface 92 in a plane 96 substantially coplanar with the connector surface 70 of a complimentary support portion 58. The top connectors 86, 88 extend from their respective connector surface 90, 92 in a direction opposite from which their respective complimentary support portion 56, 58 extends.

The two top connector portions 86, 88 have two pairs of apertures 98, 100 therethrough along respective axes that are substantially parallel to the top frame portion 18. The apertures 98, 100 are positioned a predetermined distance from the outer surface 22 of top frame portion 18.

The top connector portions 86, 88 are similar to the support portions 56, 58. The main difference being that support portions 56, 58 are larger and include a contact portion 60 spaced from the bottom frame portion 20. Support portions 56, 58 have larger dimensions in order to operate as supports for the fence panel 10 as will be herein further described.

As seen in FIG. 1, the plane 94 lies towards the side frame portion 14 of the panel 10 and across the panel through the connector surfaces 90, 68 of connector portion 86 and support portion 56, respectively. The plane 96 lies across the panel 10 through the connector surface 88 and support portion 58 and towards the side frame portion 16. The planes 94, 96 are positioned across the panel 10 so that additional panels having corresponding planes 94, 96 may be connected along the same planes, as seen from FIGS. 1 and 5.

Preferably, each connector 30, 32, 42, 44, 86, 88 and support portion 56, 58 is formed to its respective frame portion 14, 16, 18 and 20 and further secured by fillets 101. In the preferred embodiment, each connector portion 30, 32 . . . 88, and support portion 56, 58 is generally rectangularly shaped with an aperture 103 therethrough. It should be understood that it is within the contemplation of this invention that each connector portion and support portion may be of any other suitable shape or configuration allowing for up to four fence panels to be connected at one junction.

As seen in FIGS. 2 and 3, a portable fence panel connection 82 is provided for connecting two fence panels 10, 200 and includes a pin 84 at each connection. The fence panel 200 is substantially identical to the panel 10. The fence panels 10, 200 are connected by positioning a pin 84 in one pair of apertures 40 in the first connector 30 of a second panel 200 and one pair of apertures 52 of the second connector 42 of a first panel 10. Another pin 84 is then positioned in one pair of apertures 52 of the second connector 44 of the first panel 10 and one pair of apertures 40 of a first connector 32 of the second panel 200 to connect the first and second panels.

FIG. 4 is a cross-sectional view of the fence panel connection 82 taken generally along line 4—4 of FIG. 3. The pair of apertures 40 of the first connector 30 are aligned with the pair of apertures 52 of the second connector 42 allowing for the positioning of the pin 84 therein.

Figure 6:
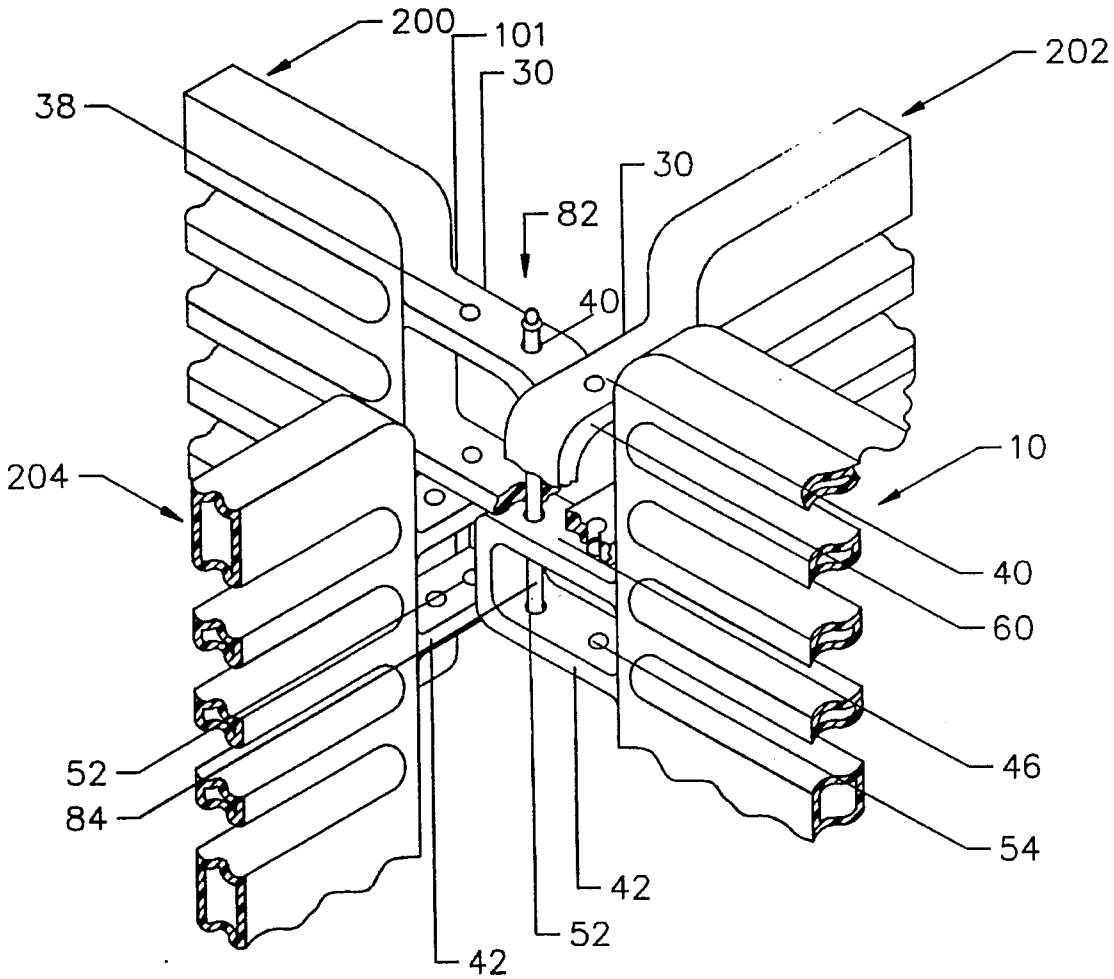
FIG. 6 is an enlarged partial sectional view of an alternate embodiment of connected fence panels.

As seen in FIG. 6, the portable fence panel connection 82 is provided for connecting three fence panels and includes a pin 84 at each connection. The third fence panel 202 is substantially identical to panels 10 and 200. It will be understood that the connection 82 of panels 10 and 200 as herein before discussed is the basis for the connection of the third panel 202. The fence panel 202 is connected by positioning a pin 84 in one pair of apertures 40 in the first connector 30 of the third panel 202 and the other pair of apertures 54 in the second connector 42 of the first panel 10. Another pin 84 is then positioned in the other pair of apertures 54 of the second connector 44 of the first panel 10 and one pair of apertures 40 of first connector 32 of the third panel 202, to connect the first, second and third panels, as can be seen from FIGS. 3 and 6. It should be understood that it is within the contemplation of this invention that the third panel 202 may be connected by its connector portions 42, 44 to the connector portions 30, 32 of the second panel 200.

The portable fence panel connection 82 is also provided for connecting four fence panels and includes a pin 84 at each connection, as seen in FIG. 6 The fourth fence panel 204 is substantially identical to panels 10, 200 and 202. It will be understood that the connection 82 of panels 10, 200 and 202 as discussed above is the basis for the connection of the fourth panel 204. The fence panel 204 is connected by positioning a pin 84 in the other pair of apertures 38 in the first connector 30 of the second panel 200 and one pair of apertures 52 in the second connector 42 of the fourth panel 204. Another pin 84 is then positioned in the one pair of apertures 52 of the second connector 44 of the fourth panel 204 and the other pair of apertures 38 in the first connector 32 of the second panel 200, to connect the first 10, second 200, third 202 and fourth 204 panels, as can be seen from FIGS. 3 and 6. It should be understood that it is within the contemplation of this invention that the fourth panel 204 may be connected by its connector portions 30, 32 to the connector portions 42, 44 of the first panel 10.

Obviously, as many panels as desired may be secured together to provide pens of different sizes and configurations. The fence panels 10, 200, 202, 204 may be connected to form a continuous line, or to form separate pens, or connected in a three or four panel junction to form rows of pens.

Figure 7:
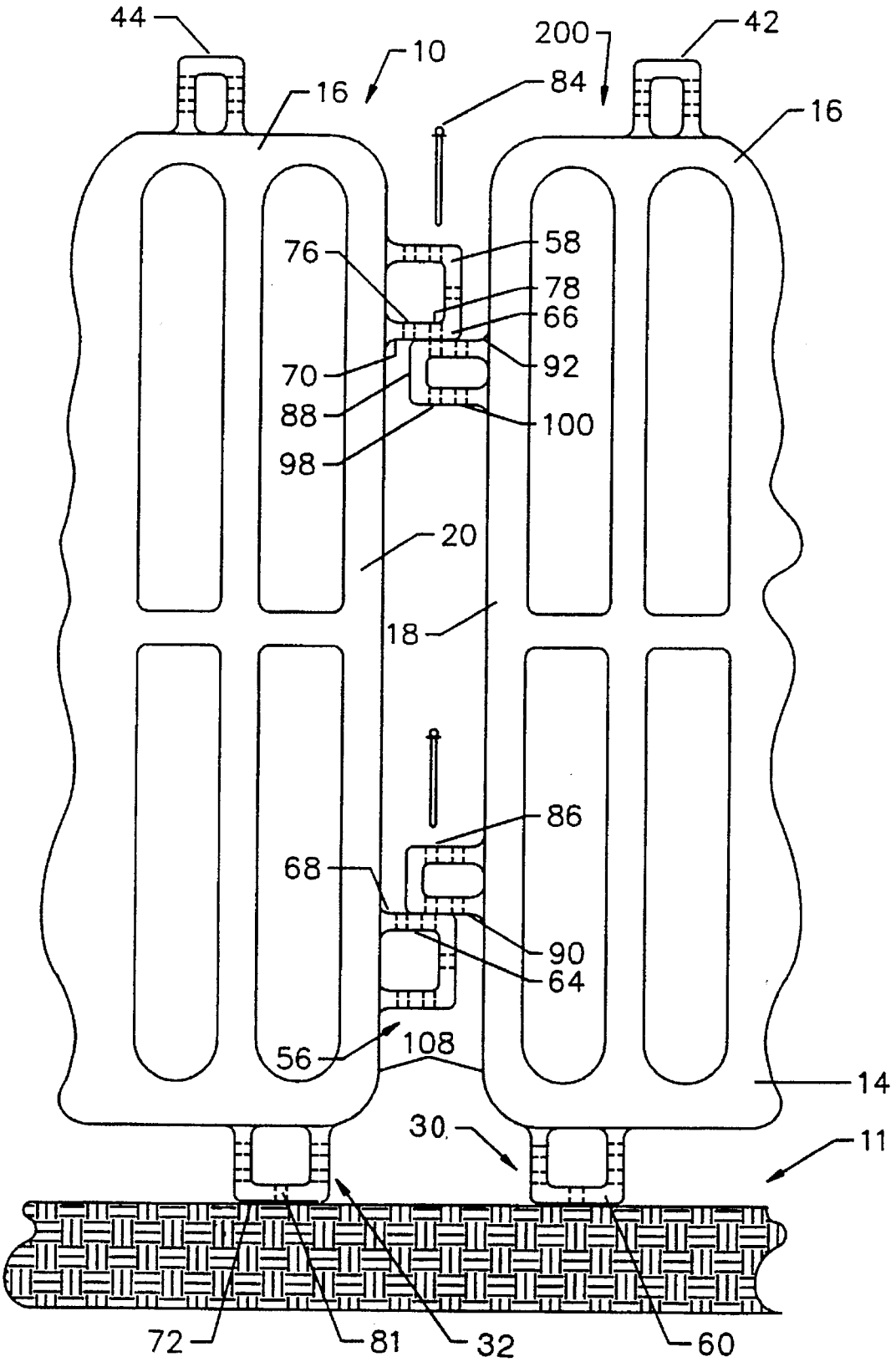
FIG. 7 is an enlarged partial view of another alternate embodiment of connected portable fence panels.

In the preferred embodiment, the portable fence panel 10 of the present invention can be used in a horizontal or vertical position, as seen in FIGS. 1 and 7. When positioned horizontally, the length of the fence panel 10 is proportionally greater than the height of the panel. Thus when positioned vertically, the height of the fence panel is proportionally greater than the width of the panel.

When containment of larger animals is desired, the fence panel 10 may be rotated 90° from the horizontal position to the vertical position. In the vertical position, the fence panel 10 is supported by the connector portions 30, 32 which have a contact portion 60 supported by the support surface 11, as seen in FIG. 7. When the panel 10 is positioned vertically, the connector portions 30, 32 operate in the same manner as support portions 56, 58 of the fence panel 10 when positioned horizontally as will be herein further described.

FIG. 7 is an enlarged view of a portion of the panels 10, 200 illustrating how they are vertically connected together. The top frame portion 18 of panel 200 is shown disposed adjacent the bottom frame portion 20 of panel 10. The panels 10, 200 are connected by joining connector portions 86, 88 of panel 200 with complementary connector portions 64, 66 respectively, of panel 10. The connector surfaces 68, 70 of connector portions 64, 66 are positioned facing the connector surfaces 90, 92 of complementary top connectors 86, 88. The panels 10, 200 are joined by aligning apertures 78 of connector portions 64, 66 with apertures 98 of top connectors 86, 88 to provide a connection between two panels 10, 200.

As seen in FIG. 7, the portable fence panel connection 82 is provided for connecting two fence panels 10, 200 in the vertical position and includes a pin 84 at each connection. The fence panel 200 is substantially identical to the panel 10. The fence panels 10, 200 are connected by positioning a pin 84 in one pair of apertures 78 of the support portion 58 of the panel 10 and one pair of apertures 98 of the top connector 88 of the second panel 200. Another pin 84 is then positioned in one pair of apertures 98 of the top connector 86 of the panel 200 and one pair of apertures 78 of the support portion 56 of the panel 10 to vertically connect the first and second panels 10, 200.

Third 202 and fourth 204 panels may also be connected in the vertical position to the fence panel connection 82 of vertically positioned panels 10, 200. The portable fence panel connection 82 is also provided for connecting three fence panels vertically and includes a pin 84 at each connection. The third fence panel 202 is substantially identical to panels 10 and 200. It will be understood that the connection 82 of panels 10 and 200 as herein before discussed is the basis for the connection of the third panel 202.

It should be understood that the connection of panels 10, 200, 202, 204 in the vertical position is performed in the same manner as the connection of these panels in the horizontal position as herein before described and shown in FIG. 6. An illustration of a four panel vertical connection is not shown and FIG. 7 in light of the description above in connection with FIG. 6 which may be reviewed for a general understanding.

The fence panel 202 is connected vertically by positioning a pin 84 in one pair of apertures 78 in the support portion 58 of the third panel 202 and the other pair of apertures 100 in the top connector 88 of panel 200. Another pin 84 is then positioned in the other pair of apertures 100 of the top connector 86 of the panel 200 and one pair of apertures 78 of a support portion 56 of the third panel 202, to connect vertically the first 10, second 200 and third 202 panels. It should be understood that it is within the contemplation of this invention that the third panel 202 may be connected by its top connectors 86, 88 to the support portions 56, 58 respectively, of the first panel 10.

The portable fence panel connection 82 is also provided for connecting four fence panels in the vertical position and includes a pin 84 at each connection. The fourth fence panel 204 is substantially identical to panels 10, 200 and 202. It will be understood that the connection 82 of panels 10, 200 and 202 as herein before discussed is the basis for the connection of the fourth panel 204.

The fence panel 204 is connected by positioning a pin 84 in the other pair of apertures 76 in the support portion 58 of the first panel 10 and one pair of apertures 98 in the top connector 88 of the fourth panel 204. Another pin 84 is then positioned in the one pair of apertures 98 of the top connector 86 of the fourth panel 204 and the other pair of apertures 76 in the support portion 56 of the first panel 10, to connect the first 10, second 200, third 202 and fourth 204 panels vertically. It should be understood that it is within the contemplation of this invention that the fourth panel 204 may be connected by its support portions 56, 58 to the top connectors 86, 88 of the second panel 200.

The fence panels 10, 200 and connections thereto are supported from the support surface 11 in the horizontal or vertical position. As seen in FIGS. 3 and 7, the fence panel 10 may be used on soft or firm support surfaces. When placed on a soft surface, the present invention provides means 80 for removably engaging the support surface 11 including apertures 81 through the contact portions 60 of the support portions 56, 58. The means 80 for removably engaging the support surface 11 includes pins 84 inserted through the apertures 81 and into the support surface 11. It should be understood that it is within the contemplation of the present invention to apply means 80 for removably engaging the support surface 11 to connector portions 30, 32 when the panel 10 is used vertically. It should also be understood that other means 80 for removably engaging the fence panel 10 to the support surface 11 is fully within the contemplation of this invention.

In the preferred embodiment of the present invention, fence panels 10, 200 may be stacked. As seen in FIG. 5, another fence panel 200 may be positioned on the top frame portion 18. A portable fence panel connection 82 is provided for connecting two fence panels and includes a pin 84 at each connection. The fence panels 10, 200 are connected by positioning a pin 84 in one pair of apertures 76 in the support portion 56 of an upper panel 200 and one pair of apertures 98 of the top connector 86 of a lower panel 10. Another pin 84 is then positioned in one pair of apertures 98 of the top connector 88 of the lower panel 10 and one pair of apertures 76 of a support portion 58 of the upper panel 200, to connect the upper and lower panels 10, 200.

The present invention provides stacking means 102 for supporting a second upper fence panel 200 on the top frame portion 18 of a first panel 10. The stacking means 102 includes two ends 104, 106 of the top frame portion 18 having a respective aperture 108 therein. The stacking means 102 further includes an independent tubular member 110 having opposing ends 112 with a diameter slightly less than the diameter of the apertures 108. Each of the apertures 108 retains one end 112 of the tubular member 110. Preferably, the tubular member 110 has a center portion 116 having a diameter larger than the diameter of the apertures 108.

To provide a base for the stacked panel 200, one end 112 of the tubular member 110 is positioned in an aperture 108 of the lower panel 10. The periphery 118 of the center portion 116 rests on the outer surface 22 of the top frame portion 18 of the lower fence panel 10.

To provide support to the stacked panel 200, the stacking means also includes two ends 120, 122 of the bottom frame portion 20 having a respective aperture 108 therein. The upper second fence panel 200 is supported by positioning the bottom frame portion 20 on top of the lower fence panel 10 so that the apertures 108 of the bottom frame portion 20 receive the other ends 112 of the tubular members 110. To provide support to the stacked panel 200, the end 112 of the tubular member 110 is received in the apertures 108 until the outer surface 22 of the bottom frame portion 20 rests on the periphery 118 of the center portion 116.

It should be understood that additional panels may be connected to the connector portions 30, 32, 42, 44 of stacked panels 10, 200 as herein before discussed.

As seen in FIG. 1 and 2, means 28 are provided for restricting passage through the fence panel 10. The means 28 for restricting passage includes crossmembers 128 extending across the two opposing side frame portions 14, 16. In the preferred embodiment, the crossmembers 128 are secured to the side portions 14, 16 during blow or rotational molding of the frame member 12. The crossmembers 128 are positioned substantially parallel between the top frame portion 18 and bottom frame portion 20. Preferably, the frame portions 14, 16, 18, 20 of the panel 10 have a width greater than the width of the crossmembers 128. It should be understood that other means for restricting passage through the frame member 12 are fully within the contemplation of this invention such as a flexible web which is removably secured to the frame member 12.

The fence panel 10 is preferably made of a relatively lightweight structurally semi-rigid material such as linear low density polyethylene (LLDPE). LLDPE provides a lightweight fence panel 10 with the physical properties of tensile strength, flexibility, and chemical and heat resistance. Preferably, the fence panel 10 has a hollow core throughout. LLDPE provides the above described properties for a fence panel 10 having a hollow core throughout. It should be understood that it is within the contemplation of this invention that the fence panel 10 may be formed from any other structurally semi-rigid material having linear low density that provides a hollow plastic portable fence panel.

In the preferred embodiment of the present invention, the fence panel 10 is fabricated by the conventional means of rotational molding. Fabrication by rotational molding using LLDPE provides the fence panel 10 with environmental stress crack resistance, strength and toughness. The fabrication by rotational molding also provides a hollow core throughout the fence panel 10. Preferably, a hollow core is provided throughout the panel to reduce panel weight and reduce material costs while maintaining strength and toughness. It should be understood that it is within the contemplation of this invention that the fence panel 10 may be fabricated by any other conventional means such as blow molding or the assembly of components.

In the preferred embodiment of the present invention, the structurally semi-rigid material forming the portable plastic fence panel 10 includes an ultraviolet stabilizer. Hindered-amine light stabilizers (HALS) are the preferred UV stabilizer included in the structurally semi-rigid material forming the fence panel 10. The UV stabilizer minimizes the harmful ultraviolet rays when the panel 10 is positioned outdoors while maintaining the physical properties of the low linear density plastic used to form the panel 10. It should be understood that it is within the contemplation of this invention that other conventional UV stabilizers such as carbon black or rutile may be used.

The invention has been described with the references to the preferred embodiments. Obviously, modifications and alterations will occur to others upon reading and understanding of this specification. It is my intention to include all modifications and alterations insofar as they come within the scope of the appended claims or equivalents thereof.

What is claimed is:

1. A portable fence panel for use on a support surface comprising:

(a) a plastic frame member having a pair of side frame portions and a top and a bottom frame portion, said side frame portions connecting said top and bottom portions to form a generally rectangular frame, each of said frame portions having an outer surface and an inner surface defining an aperture through said frame member, said frame member is constructed of a semi-rigid plastic having a low linear density and a hollow core throughout;

(b) means positioned in said aperture of said frame member for restricting passage therethrough;

(c) upper and lower first connector portions extending from said outer surface of one of said side frame portions, each of said first connector portions defining a first connector surface with said first connector portion extending from one side thereof, each of said first connector portions having at least one aperture therethrough along an axis substantially parallel to said one side frame portion and positioned a predetermined distance from said outer surface of said one side frame portion, said upper first connector portion extending from said first connector surface in an upward direction and said lower first connector portion extending from said first connector surface in a downward direction;

(d) upper and lower second connector portions extending from said outer surface of the other of said side frame portions, each of said second connector portions defining a second connector surface in a plane substantially coplanar with said first connector surface of a complimentary first connector portion, each of said second connector portions extending from said second connector surface in a direction opposite from which its complimentary first connector portion extends, each of said second connector portions having at least one aperture therethrough along an axis substantially parallel to said other side frame portion and positioned a predetermined distance from said outer surface of said other side frame portion;

(e) a plurality of support portions extending from said outer surface of said bottom frame portion, each of said support portions having a contact portion spaced from said outer surface of said bottom frame portion and a connector portion having a connector surface defining one side of said support portion, said contact portion having a contact surface for support by the support surface, said connector portion of said support portions having at least one aperture therethrough along an axis substantially parallel to said bottom frame portion and positioned a predetermined distance from said outer surface of said bottom frame portion, at least one of said support portions having an additional aperture therethrough substantially perpendicular to said at least one aperture of said at least one support portion.

2. A portable fence panel for use on a support surface as described in claim 1 including a plurality of top connector portions extending from said outer surface of said top frame portion and defining a top connector surface in a plane substantially coplanar with said connector surface of a complimentary support portion, each of said top connector portions extending from said top connector surface in a direction opposite from which its complimentary support portion extends, each of said top connector portions having at least one aperture therethrough along an axis substantially parallel to said top frame portion and positioned a predetermined distance from said outer surface of said top frame portion.

3. A portable fence panel for use on a support surface as described in claim 1 including stacking means for supporting a second portable fence panel on said top frame portion of said portable fence panel.

4. A portable fence panel for use on a support surface as described in claim 3 wherein said stacking means includes a tubular member and at least one aperture in said outer surface of said top frame portion, said tubular member having opposing end portions and a center portion, one of said end portions positioned in said aperture in said outer surface of said top frame portion and the other of said end portions of said tubular member receivable in an aperture in the outer surface of the bottom frame portion of the second panel so that said outer surfaces of said frame portions rest on said center portion of said tubular member.

5. A portable fence panel for use on a support surface as described in claim 1 wherein said means for restricting passage through said frame member includes a plurality of crossmembers extending between said side frame portions, said crossmembers positioned substantially parallel between said top and bottom frame portions.

6. A portable fence panel for use on a support surface as described in claim 1 including means for removably engaging the support surface.

7. A portable fence panel for use on a support surface comprising:

(a) a plastic frame member having a pair of side frame portions and a top and a bottom frame portion, said side frame portions connecting said top and bottom portions to form a generally rectangular frame, each of said frame portions having an outer surface and an inner surface defining an aperture through said frame member;

(b) means positioned in said aperture of said frame member for restricting passage therethrough;

(c) a plurality of first connector portions extending from said outer surface of one of said side frame portions, each of said first connector portions defining a connector surface with said first connector portion extending a predetermined length from one side of its said connector surface along said one side frame portion, each of said first connector portions having at least one aperture therethrough along an axis substantially parallel to said one side frame portion and positioned a predetermined distance from said outer surface of said one side frame portion, at least one of said first connector portions having an additional aperture therethrough substantially perpendicular to said at least one aperture of said at least one first connector portion;

(d) a plurality of second connector portions extending from said outer surface of the other of said side frame portions, each of said second connector portions defining a connector surface in a plane substantially coplanar with said connector surface of a complimentary first connector portion, each of said second connector portions extending from its connector surface along said other side frame portion a distance less than the predetermined length of said first connector portion in a direction opposite from which its complimentary first connector portion extends, each of said second connector portions having at least one aperture therethrough along an axis substantially parallel to said other side frame portion and positioned a predetermined distance from said outer surface of said other side frame portion;

(e) at least one support portion extending from the outer surface of said bottom frame portion, said support portion having a contact portion for support by the support surface.

8. A portable fence panel for use on a support surface as described in claim 7 including a plurality of support portions extending from said outer surface of said bottom frame portion, each of said support portions having a contact portion spaced from said outer surface of said bottom frame portion and a connector portion having a connector surface defining one side of said support portion, said contact portion of said support portions having a contact surface for support by the support surface, said connector portion of said support portion having at least one aperture therethrough along an axis substantially parallel to said bottom frame portion and positioned a predetermined distance from said outer surface of said bottom frame portion.

9. A portable fence panel for use on a support surface as described in claim 7 including means for removably engaging the support surface.

10. A portable fence panel for use on a support surface as described in claim 9 wherein said means for removably engaging the support surface include said contact portion of said support portion having an aperture therethrough, said contact portion of said support portion includes at least one pin member positioned through said aperture of said contact portion and receivable in the support surface.

11. A portable fence panel for use on a support surface as described in claim 7 wherein said fence panel is constructed of a semi-rigid material having a low linear density and a hollow core throughout.

12. A portable fence panel for use on a support surface as described in claim 7 wherein said fence panel is constructed of a semi-rigid material including an ultraviolet stabilizer.

* * * * *